US010775027B2

(12) United States Patent
Wang

(10) Patent No.: US 10,775,027 B2
(45) Date of Patent: Sep. 15, 2020

(54) FLASHLIGHT TAMPER-PROOF STRUCTURE

(71) Applicant: Shih-hao Wang, Tainan (TW)

(72) Inventor: Shih-hao Wang, Tainan (TW)

( * ) Notice: Subject to any disclaimer, the term of this patent is extended or adjusted under 35 U.S.C. 154(b) by 0 days.

(21) Appl. No.: 13/733,935

(22) Filed: Jan. 4, 2013

(65) Prior Publication Data

US 2014/0192522 A1 Jul. 10, 2014

(51) Int. Cl.

| | |
|---|---|
| ***F21L 4/04*** | (2006.01) |
| ***F21V 17/04*** | (2006.01) |
| ***F21L 4/00*** | (2006.01) |
| *F21Y 115/10* | (2016.01) |

(52) U.S. Cl.

CPC ..... *F21V 17/04* (2013.01); *F21L 4/00* (2013.01); *F21Y 2115/10* (2016.08)

(58) Field of Classification Search

CPC ..... F21L 4/005; F21V 17/04; F21Y 2101/02
USPC ..... 362/171–174, 178, 188, 190, 194–208
See application file for complete search history.

(56) References Cited

U.S. PATENT DOCUMENTS 2,592,208 A * 4/1952 Stamper ..... F21L 4/00 362/208
2012/0281394 A1* 11/2012 Weber ..... F21L 4/005 362/186

* cited by examiner

*Primary Examiner* — Ali Alavi
(74) *Attorney, Agent, or Firm* — Alan D. Kamrath; Mayer & Williams PC

(57) ABSTRACT

A flashlight tamper-proof structure for preventing a lamp cover fastened to an end of a flashlight from being unfastened manually includes an appropriate section of an end of an opening of a body of the flashlight extending to form a carrying portion; an internal thread section penetrating a front end of the carrying portion; a hole formed at a corresponding point of a rear end of the carrying portion, to allow a screw to be inserted into the carrying portion and screwed to the internal thread section with a tool; and concave indentations formed at the periphery of the opening of the lamp cover fastened to the end of the opening of the body of the flashlight The screw screwed to the internal thread section is moved forward with the tool to reach the concave indentations.

5 Claims, 3 Drawing Sheets

FLASHLIGHT TAMPER-PROOF STRUCTURE

BACKGROUND OF THE INVENTION

1. Technical Field

The present invention provides a flashlight tamper-proof structure including an appropriate section of an end of an opening of a body of a flashlight capable of illumination extending to form a carrying portion; a screw inserted and screwed to an internal thread section of the front end; and a plurality of concave indentations formed at the periphery of the opening of the lamp cover fastened to the end of the opening of the body of the flashlight. The screw screwed to the internal thread section of the front end of the carrying portion on one side of the body of the flashlight can be moved forward with the tool to reach the concave indentations at the periphery of the lamp cover. Accordingly, the lamp cover fastened to an end of the flashlight cannot be unfastened manually.

2. Description of Related Art

A conventional flashlight capable of illumination has to meet a safety standard (UL) that a lamp cover of the flashlight cannot be manually unfastened but can only be unfastened with a tool. To this end, related manufacturers put forth a flashlight essentially comprising a flashlight body and a lamp cover which are tightly engaged with each other when put together or are integrally formed as a unitary structure, such that a user needs a tool to separate the flashlight body and the lamp cover in order to change a light bulb therein or has to dismount from or mount on the other end of the flashlight body an object.

Therefore, it imperative to provide a flashlight tamper-proof structure for preventing a lamp cover from being unfastened without a tool.

SUMMARY OF THE INVENTION

The present invention provides a flashlight tamper-proof structure for preventing a lamp cover fastened to a front end of an illumination-oriented flashlight from being unfastened manually. The flashlight tamper-proof structure includes an appropriate section of an end of an opening of a body of a flashlight extending to form a carrying portion to allow a screw to be inserted into the opening and screwed to an internal thread section penetrating the front end; and a plurality of concave indentations formed at the periphery of the opening of the lamp cover fastened to the end of the opening of the body of the flashlight. The screw screwed to the front end of the carrying portion on one side of the body of the flashlight can be moved forward to reach the concave indentations at the periphery of the lamp cover. Accordingly, the lamp cover fastened to an end of the flashlight cannot be unfastened manually.

The first objective of the present invention is to prevent a lamp cover fastened to an end of a flashlight from being unfastened manually. The present invention includes an appropriate section of an end of an opening of a body of a flashlight extending to form a carrying portion; an internal thread section penetrating a front end of the carrying portion; a hole formed at a corresponding point of a rear end of the carrying portion, to allow a screw to be inserted into the carrying portion and screwed to the internal thread section of the front end with a tool; and a plurality of concave indentations formed at the periphery of the opening of the lamp cover fastened to the end of the opening of the body of the flashlight. The screw screwed to the front end of the carrying portion on one side of the body of the flashlight can be moved forward with the tool to reach the concave indentations at the periphery of the lamp cover. Accordingly, the lamp cover fastened to an end of the flashlight cannot be unfastened manually.

The second objective of the present invention is that the internal thread section penetrating the front end of the carrying portion formed by extending an appropriate section of an end of an opening of a body of a flashlight can be implemented by a nut embedded at the front end of the carrying portion.

The third objective of the present invention is that the carrying portion formed by extending an appropriate section of an end of an opening of a body of a flashlight forms a channel-shaped container opening at the top thereof to allow the screw screwed to the internal thread section at the front end of the carrying portion to fall into between the carrying portion after the screw has been unfastened, such that the screw can be conveniently screwed again at any time and moved forward to reach the concave indentations at an end of the lamp cover.

The fourth objective of the present invention is that the diameter of a hole at a rear end of the carrying portion formed by extending an appropriate section of an end of an opening of a body of a flashlight permits admission of an end of a conventional tool for use in fastening the screw.

DETAILED DESCRIPTION OF THE EMBODIMENTS OF THE INVENTION

Figure 1:
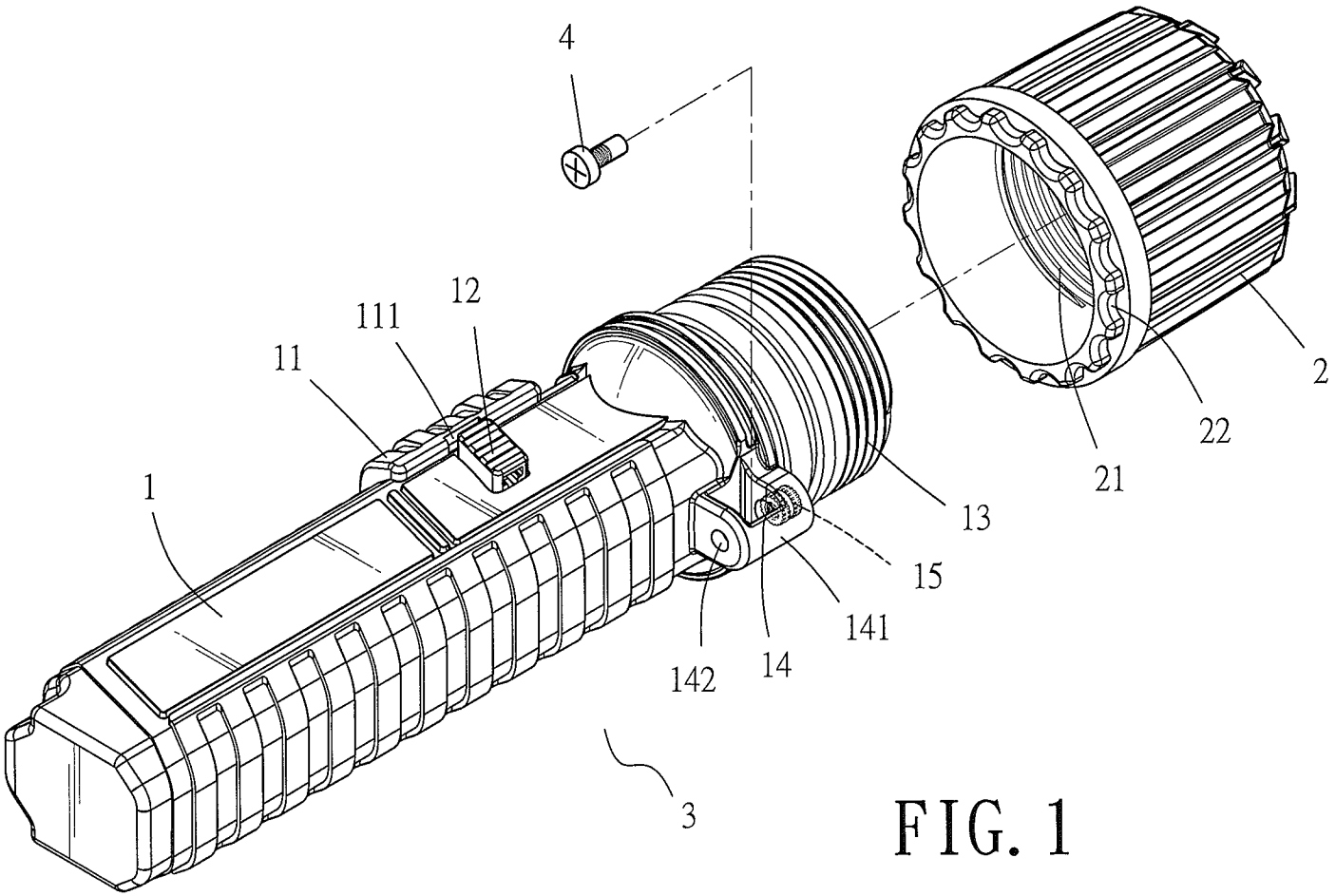
FIG. 1 is an exploded view of a flashlight tamper-proof structure according to the present invention.

Referring to FIG. 1, the present invention provides a flashlight tamper-proof structure for preventing a lamp cover 2 fastened to an end of an opening of a body 1 of a flashlight 3 from being unfastened manually. The flashlight tamper-proof structure essentially comprises the body 1 and the lamp cover 2.

The body 1 has therein a space for receiving a power-supplying battery. A power switch 11 is disposed at the periphery of one side of the body 1 and is adapted to control the ON/OFF of a flashlight lamp. A security switch 12 is pivotally disposed at a predetermined segment of the power switch 11 at the body 1 and is adapted to be movably pushed in or moved out for controllably pushing the power switch 11 into a laterally-positioned recess portion 111 whenever the power switch 11 is not in use to thereby prevent the power switch 11 from being wrongly turned on. An end of the opening of the body 1 extends to form an external thread section 13 for fastening the lamp cover 2. An appropriate section of the end of the opening of the body 1 extends to form a carrying portion 14. In this embodiment, the carrying portion 14 is provided in the form of a channel-shaped container that opens at the top thereof. An internal thread section 141 penetrates the front end of the carrying portion 14, and the internal thread section 141 penetrating the front end of the carrying portion is implemented by a nut 15 embedded at the front end of the carrying portion 14. A hole 142 is formed at a corresponding point of a rear end of the carrying portion 14, to allow a screw 4 to be inserted into the carrying portion 14. The screw 4 is screwed to the internal thread section 141 of the front end with a tool 5, and the diameter of the hole 142 at the rear end of the carrying portion 14 permits admission of an end of the tool 5 for use in fastening the screw 4.

The coverage of the flashlight lamp by the lamp cover 2 depends on the external thread section 13 extending from an end of the opening of the body 1. An internal thread section 21 is formed inside the lamp cover 2. A plurality of concave indentations 22 is formed at the periphery of the opening of the lamp cover 2. The internal thread section 21 and the concave indentations 22 at the opening of the lamp cover 2 can be implemented together in the form of an element, such that the element and the lamp cover 2 are integrally formed as a unitary structure by bagging.

Figure 2:
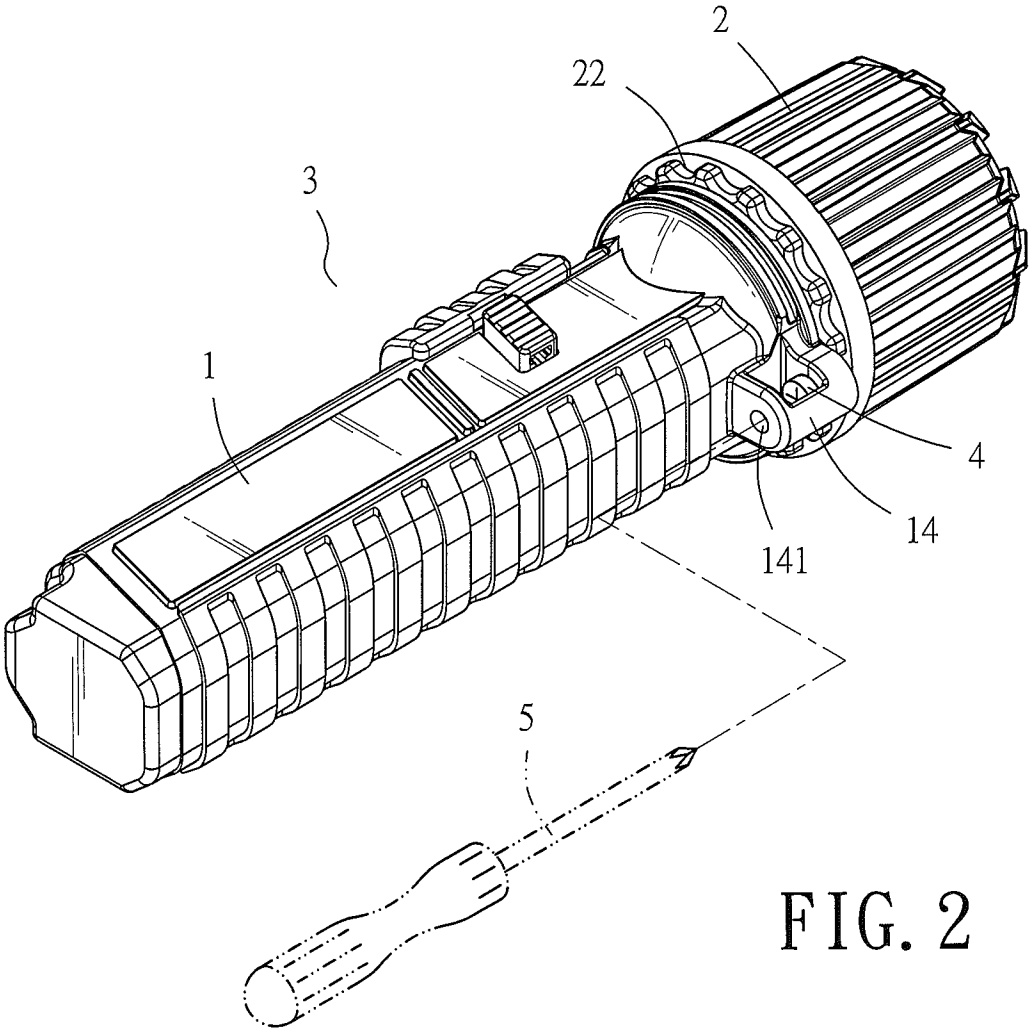
FIG. 2 is a schematic view of assembly and operation of the flashlight tamper-proof structure according to the present invention.

Referring to FIG. 1 and FIG. 2, there are shown diagrams of the fastening together of the body 1 and the lamp cover 2.

Figure 4:
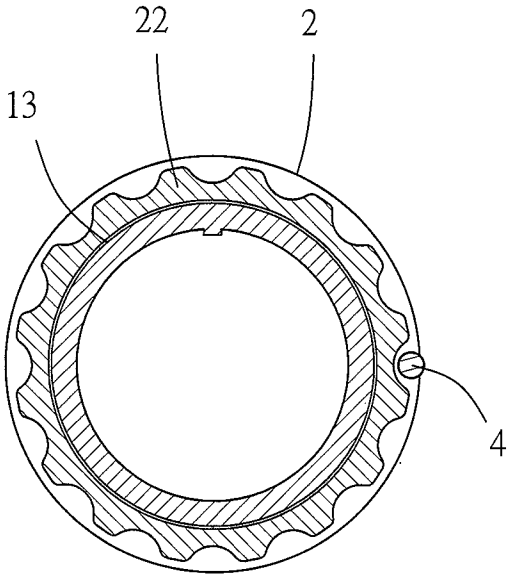
FIG. 4 is a cross-sectional view of the flashlight tamper-proof structure taken along line 40-40 of FIG. 3.
Figure 3:
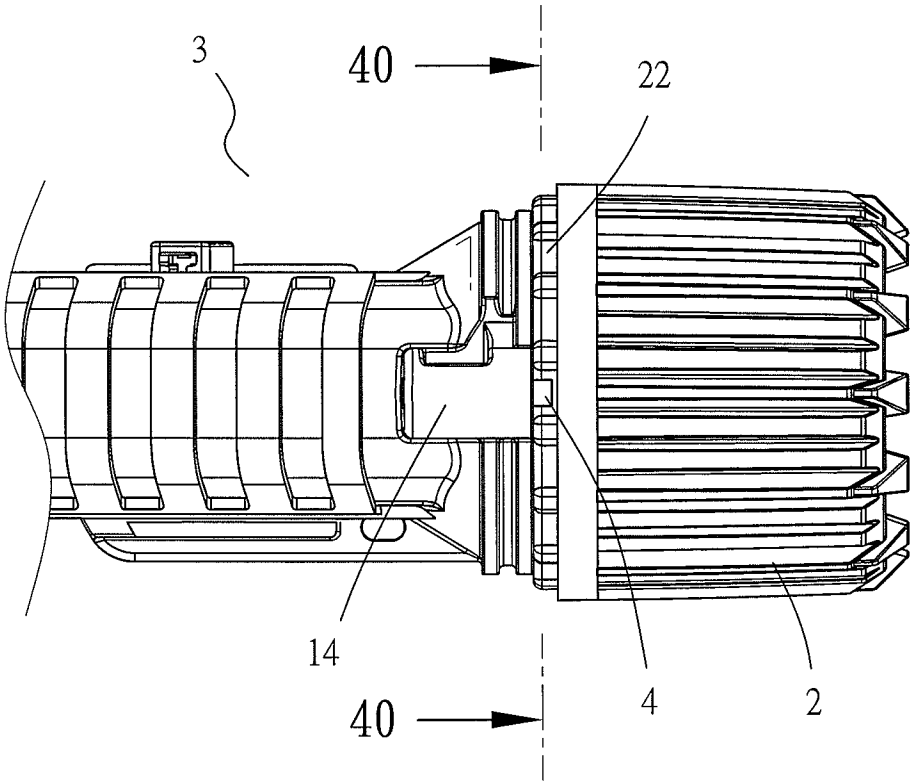
FIG. 3 is an enlarged view of a portion of the flashlight tamper-proof structure according to the present invention.

Step 1: fastening the lamp cover 2 to the external thread section 13 at an end of the opening of the body 1. Step 2: positioning the screw 4 between the carrying portion 14 on one side of the body 1, and guiding, with the tool 5 (in the form of a screwdriver), the screw 4 into the hole 142 at the rear end of the carrying portion 14. The screw 4 is screwed to the internal thread section 141 at the front end to thereby allow the screw 4 to move forward to reach the concave indentations 22 at the periphery of the lamp cover 2 (see FIG. 3 and FIG. 4). Accordingly, the lamp cover 2 fastened to an end of the body 1 of the flashlight cannot be unfastened manually.

Unfastening the lamp cover 2 which is otherwise fastened to an end of the opening of the body 1 entails: unscrewing the screw 4 from the front end of the carrying portion 14 on one side of the body 1 by use of the tool 5, such that the screw 4 is released from the concave indentations 22 at the periphery of the opening of the lamp cover 2. The screw 4 thus loosened can fall into between the carrying portion 14, thereby allowing the screw 4 to be conveniently screwed again at any time and moved forward to reach the concave indentations 22 at the end of the lamp cover 2. Accordingly, the flashlight tamper-proof structure meets a safety standard (UL) of flashlight products that a lamp cover of a flashlight cannot be unfastened without a tool.

What is claimed is:

1. A flashlight tamper-proof structure comprising: a lamp cover including a cover opening having inner threads extending concentric to a thread axis; a body including a body opening having external threads extending concentric to the thread axis and threadably engaged with the inner threads, with the body including a carrying portion having a front end and a rear end spaced from the first end away from the lamp cover and parallel to the thread axis; wherein an internal thread section penetrates the front end of the carrying portion and is fixed and not moveable relative to the body; wherein a hole is formed at the rear end of the carrying portion; a screw inserted between the front end and the rear end and into the carrying portion, wherein the screw includes a threaded shaft terminating in a head, wherein the threaded shaft is screwed to the internal thread section of the front end and extends parallel to the thread axis, wherein the head is located intermediate the internal thread section and the hole, with the hole configured to receive a tool extending through the hole and aligned with the screw; and a plurality of concave indentations extending parallel to the thread axis and the screw and formed at a periphery of the cover opening of the lamp cover fastened to the body opening of the body, wherein the screw screwed to the internal thread section of the front end of the carrying portion is moved forward relative to the body with the tool to reach the plurality of concave indentations at the periphery of the lamp cover, wherein the internal thread section is intermediate the plurality of concave indentations and the rear end, and wherein the lamp cover fastened to an end of the flashlight cannot be unfastened manually.

2. The flashlight tamper-proof structure of claim 1, wherein the internal thread section of the front end of the carrying portion is a nut embedded at the front end of the carrying portion.

3. The flashlight tamper-proof structure of claim 1, wherein a container opening between the front end and the rear end allows the screw to fall between the front and rear ends after the screw has been unfastened, with the screw screwed again at any time and moved forward to reach the plurality of concave indentations.

4. The flashlight tamper-proof structure of claim 1, wherein a diameter of the hole at the rear end of the carrying portion is configured to admit an end of the tool for use in fastening the screw.

5. The flashlight tamper-proof structure of claim 1, wherein the screw and the head are spaced from the hole and the rear end parallel to the thread axis when the screw reaches the plurality of concave indentations.

* * * * *